US005444945A

United States Patent [19]

Goodwin

[11] Patent Number: 5,444,945

[45] Date of Patent: Aug. 29, 1995

[54] WALL PANELLING SYSTEM

[75] Inventor: David Goodwin, Warren Lane, Great Britain

[73] Assignee: Thrislington Sales Limited, Deeside, England

[21] Appl. No.: 980,952

[22] Filed: Nov. 24, 1992

[30] Foreign Application Priority Data

Nov. 25, 1991 [GB] United Kingdom ..... 9125009

[51] Int. Cl.[6] ..... E04B 2/90; E04B 1/344

[52] U.S. Cl. ..... 52/65; 49/394; 52/220.1; 52/506.06; 52/508; 52/768; 292/199; 292/204

[58] Field of Search ..... 52/508, 65, 766, 767, 52/768, 475, 479, 481, 483, 220.1, 506.06, 506.08; 49/394; 292/199, 195, 204

[56] References Cited

U.S. PATENT DOCUMENTS

| | | | |
|---|---|---|---|
| 2,359,244 | 9/1944 | Polson | 49/394 |
| 2,751,639 | 6/1956 | Oswald | 292/199 |
| 4,429,910 | 2/1984 | Anderson | 292/199 |
| 4,807,914 | 2/1989 | Fleming et al. | 49/394 |

*Primary Examiner*—Michael Safavi
*Attorney, Agent, or Firm*—Patterson & Keough

[57] ABSTRACT

A wall panelling system comprising two upright posts 13, a panel 11, a hinge 19 connecting the panel to one of the posts 13 and a lock 21 for locking the panel to another post. The posts 13 have a cross-sectional shape which provides features for the attachment of the hinge 19 and the locking means 21. The locking means comprises a latch member 23 pivotally mounted with respect to its post 13 and a catch 22 fixed relative to the panel 11. The latch member 23 is movable by means of a pinion 28 which meshes with teeth 27 on the latch member 23.

20 Claims, 4 Drawing Sheets

WALL PANELLING SYSTEM

The present invention relates to a wall panelling system, as might for example be used for simply adding a wall or for defining a deeper space (or duct) between the panelling and the wall. The invention is particularly suitable but not exclusively applicable in the construction of public sanitary areas.

In early methods of erecting panelling for public sanitary areas, such as lavatories and washrooms the greater part of the construction work was carried out on-site. Thus, timber members were cut to size and fitted together to form a framework, and panels were cut to size and fitted together to form a framework, and panels were cut to size and attached to the framework. The framework supported any sanitary units, pipework etc. This method required a great deal of on-site expertise and called for accurate work under inconvenient conditions, and was particularly difficult when accurate location of large components was required.

While this method is still widely practised, an improved method has been devised by the present applicants; this is described in British Patent No. 2181169, and has proved to have been very advantageous. This system employs a prefabricated frame comprising two posts, and three cross members. A panel is hinged to one post and is locked with respect to the other post, the two posts providing means for the attachment of the hinge, lock and cross-members. It has been successful in providing a panelling system which can be constructed with a minimum of on-site work, which has sufficient tolerance to allow for on-site adjustability and which allows easy access to the region behind the panelling.

However, this system suffers a number of minor drawbacks, namely, a larger than ideal gap between adjacent panels (to allow the panels to be opened) which cannot be reduced and the fact that the locking screws are rather clearly visible and accessible in the gap.

There is therefore some scope for improvement in addressing these points, and the present invention has this as its object.

According to the invention, there is provided a wall panelling system comprising two upright posts, a panel, a hinge connecting the panel to one of the posts, and means for locking the panel to the other post, the post having a cross-sectional shape providing features for the attachment of the hinge and the locking means, the locking means comprising a latch member pivotally mounted with respect to the first post and a catch fixed relative to the panel, the latch member being movable by means of an actuating element between a latched position in which it engages the catch and an unrelated position in which it does not.

The system preferably also includes a plurality of cross members running between the posts, the posts providing features for their attachment.

As with the present Applicants' earlier design, the majority of the accurate sizing and preparation of the components may be carried out prior to their delivery to the site, e.g. in a factory. Preferably, the posts are metal extrusions and so, effectively, the accuracy of the final structure is attained through the accuracy of the extrusion and the preparatory work in the factory, rather than on-site expertise in preparing the basic components.

One particularly difficult on-site operation which can be avoided is hanging the panel on a hinge, since the hinge can be attached to the panel in the factory while the necessary means for attachment are present in the form of the post. This is a great advantage when the relevant panel is large and therefore heavy. Similarly, all the panel locking components can be pre-positioned in the factory.

The hinged connection of the panel allows for easy access to any components located behind the panel. In the case of the panels associated with water closets, wash-basins etc, such components may include water supply, drains and possibly a power supply.

Preferably, the latch member is pivotally mounted on a latch bracket which is fixed to the first post, possibly by means of a screw or bolt engaging a channel in the post, and the actuating element comprises a pinion gear which engages a toothed portion of the latch member. Thus, manual rotation of the pinion gear by means of a suitable key can raise or lower or otherwise move the latch member relative to the catch.

Preferably, the hinge comprises a first hinge element on a hinge bracket which is fixed to the second post, again possibly by means of a screw or bolt engaging a channel in the post via a horizontal slot in the bracket, and a second hinge element which is let into the rear surface of the panel. The second hinge element is preferably a housing including a vertical pin on which the hinge bracket may pivot. Thus, the pivotal axis of the panel is actually within the panel resulting in a reduction in the throw of the panel into the gap between itself and an adjacent panel and the possible consequential reduction in the size of that gap. At the same time, the hinge remains concealed.

In the case of both the lock and the hinge, vertical adjustment is accommodated by the channel in the post, while horizontal adjustment of the latch and respective hinge should not be necessary due to the accurate performing of the components in the factory. However, a larger gap, for example, to accommodate a partition may be provided by employing a hinge bracket of a different size. Some horizontal adjustability in the hinge is preferably provided, for example by a slot in the hinge bracket through which the screw or bolt passes. This allows the attitude of the panel in its plane to be adjusted.

Preferably, the cross members comprise a top rail, a bottom rail and an intermediate cross member. The intermediate cross member may be a sturdy timber element which may be used to support the components in front of the panels, such as wash basins etc.

Preferably, the system includes a foot member for each post, the cross-sectional shape of each post providing a feature for engagement with the respective foot member. Each foot member may comprise a foot with an upright threaded member and an adjustable nut on the threaded member, the upright being received by a cross-sectional feature of the post and the post being adjustably supported by means of the nut. These features may provide a degree of on-site adjustability, both horizontally and vertically.

The system preferably further includes a horizontal channel for attachment to the floor, in which channel the feet are received. It may also includes pair of inverted post members, one at the top of each post and a horizontal channel for attachment to a ceiling, in which channel the inverted post members are received. A skirt may be attached to each horizontal channel.

Naturally, a series of panels may be located side-by-side, all using common horizontal channels for the feet. They may be separated by various infil panels which may include partitions, for example, to define cubicles. Where the system is to be used as to provide cladding, each post may be effectively combine the functions of a first post for a first panel and those of second post for an adjacent panel. Such a combined post may be fixed directly back to the wall. In order to aid positioning of the posts, a horizontal rail may first be fixed to the wall near the top. A suspension element may then be suspended from the rail and screws or bolts on the suspension element located in corresponding bores in the post. Such a system may not require feet and may not be self-supporting but simply attached to the wall.

Where the system is to be used to provide ducting, brackets may be provided to connect the posts to the wall. The cross-sectional shape of each post preferably provides a feature, such as a channel, for the attachment of the brackets by for example bolts or screws.

Each post may also provide means for the attachment of a partition support which would preferably connect two immediately adjacent posts and would provide means for locating a partition at right angles between adjacent panels.

The invention may be carried into practice in various ways and some embodiments will now be described by way of example with reference to the accompanying drawings, in which.

Figure 1:
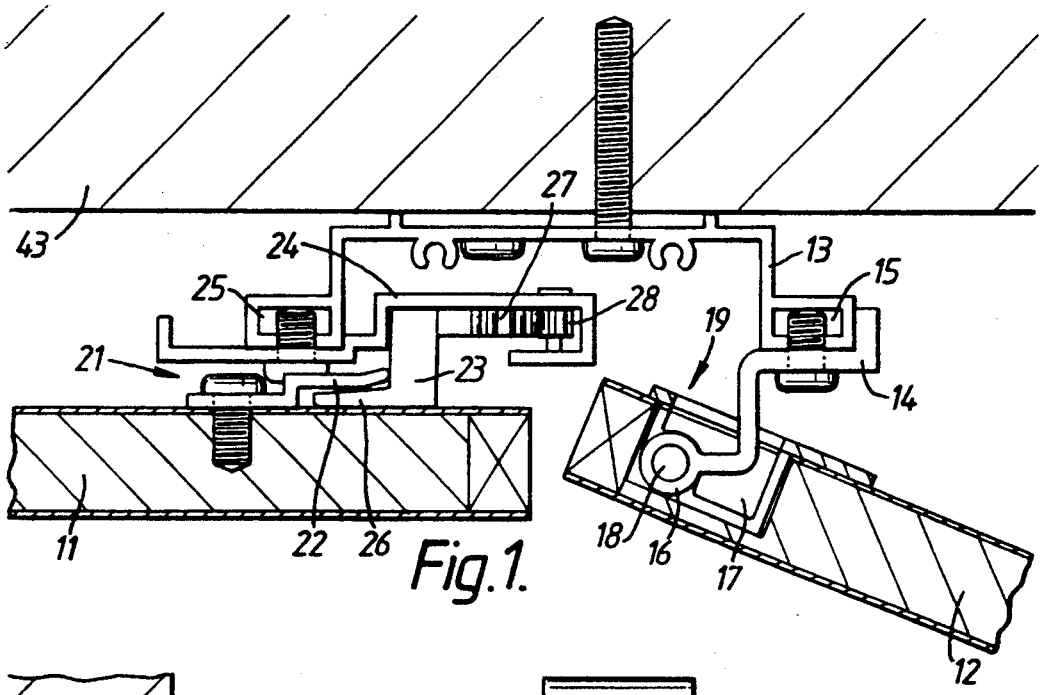
FIG. 1 is a plan view, partly in section, of a wall panelling system in accordance with the invention providing cladding.
Figure 2:
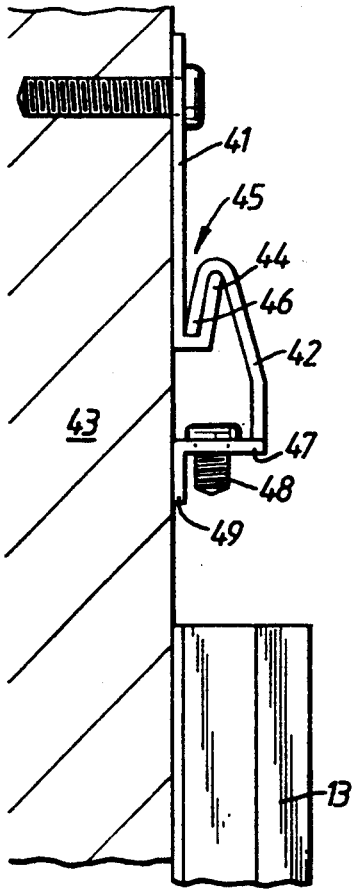
FIG. 2 is a side view, partly in section, of the means for locating the system shown in FIG. 1.
Figure 3:
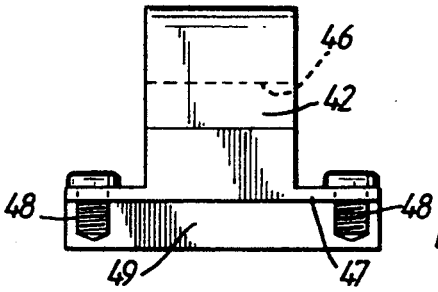
FIGS. 3 and 4 are respective front elevations of a suspension element and post as shown in FIG. 2.
Figure 4:
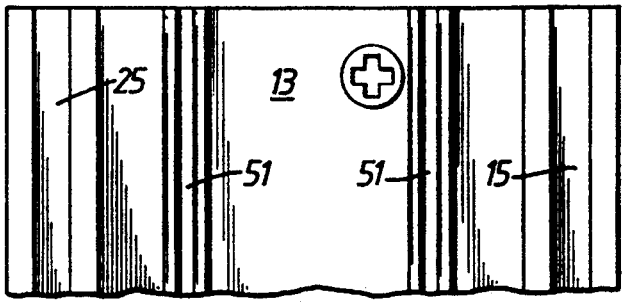
Figure 5:
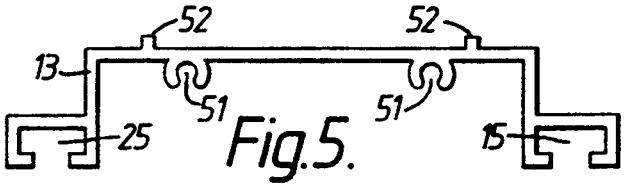
FIG. 5 is a plan view of the post.

FIG. 1 shows the adjacent edges of two panels 11,12 which are associated with a single post 13. However it is to be understood that the left-hand side of the left-hand panel 11 as shown will be similar to the left-hand side of the right-hand panel 12, and will engage a similar post in a similar fashion.

Each panel eg. 12 is attached to the post 13 through two or more hinge brackets 14 (one of which is shown). The hinge bracket 14 is screwed to a channel 15 formed in the post 13. The channel 15 allows vertical adjustment while horizontal adjustment is not necessary, the components having been accurately pre-formed in the factory.

The hinge bracket 14 has at its free end a bush 16. The panel 12 has a housing 17 let into a cavity in the rear surface. A pin 18 in the housing 17 fits within the bush 16 to provide a hinge assembly 19 for the panel 12 whose axis is within the panel. The hinge assembly 19 is in fact preassembled prior to its being connected to the panel 12. The pin 18 is passed through a hole (not shown in one end of the housing 17, then through the bush 16 and finally into another hole (not shown) in the opposite end of the housing 17. When the housing 17 is located in the cavity in the panel 12, the pin 18 is held captive and the hinge bracket 14 is thereby attached to the panel 12 via the bush 16.

Figure 6:
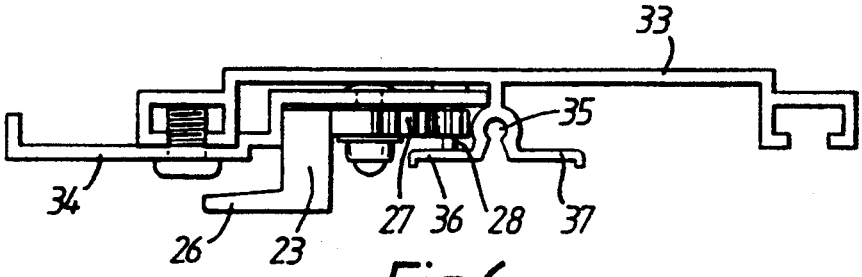
FIG. 6 is a plan view of the locking mechanism.
Figure 7:
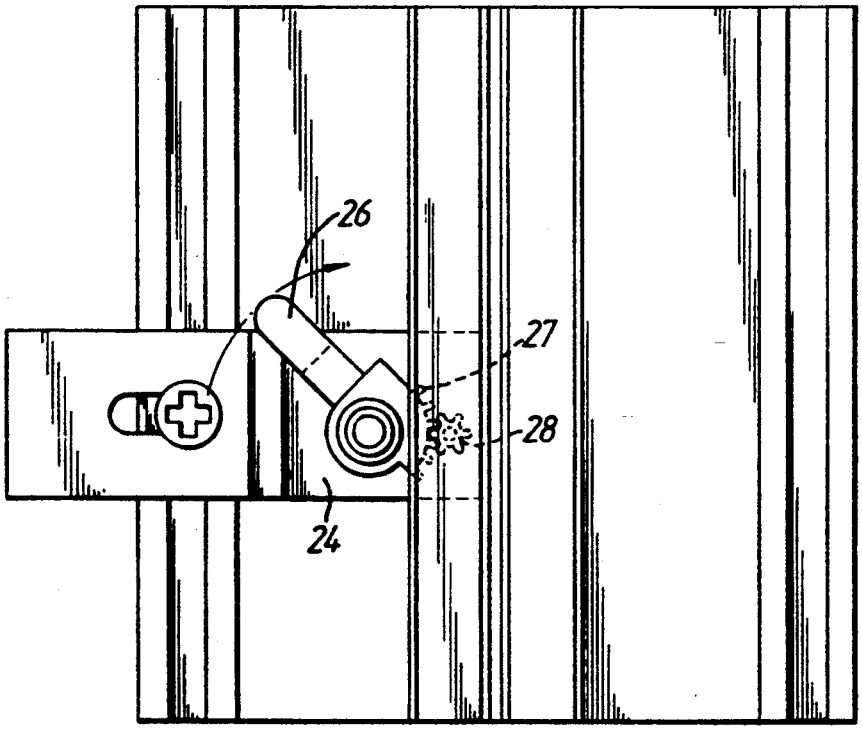
FIG. 7 is a front elevation of the locking mechanism of FIG. 6.

At the opposite side, each panel eg. 11 has a locking mechanism 21 also shown in FIGS. 6 and 7. The mechanism 21 includes a catch 22 fixed to the rear of the panel 11 and a latch member 23 pivotally mounted on a latch bracket 24. The latch bracket 24 is screwed to a channel 25 formed in the post 13. The channel 25 allows vertical adjustment while horizontal adjustment is again unnecessary.

The latch member 23 includes a tab 26 and a toothed section 27 which operatively engages a pinion 28 rotatably mounted on the latch bracket 24. Thus, rotation of the pinion 28, for example by a suitable tool (not shown) will cause the latch member 13 to pivot thereby allowing the tab 26 to locate behind the catch 22.

The arrangement shown in FIGS. 6 and 7 is similar except that the post 33 and the latch bracket 34 have slightly different respective cross-sections. Specifically, the post 33 has a small central open bore 35 and two lateral flanges 36,37 one on each side of the bore 35 while the latch bracket 34 is consequently truncated at the right-hand side as shown.

The system shown in FIG. 1 is located by means of a horizontal rail 41 and a series of suspension mounts 42. The rail 41 is screwed to the wall 43 near the top. It has an upturned portion 44 along its lower edge providing an elongate horizontal channel 45. Each mount 42 includes a hooked part 46 at the top, a horizontal plate 47 and a buffer 49 along the rear edge of the plate 47. Two screws 48 extend downwards through the plate 47.

To locate a post 13 prior to its actually being fixed to the wall 43, a mount 42 is attached to the post 13 by means of the screws 48 which are received in a corresponding pair of bores 51 in the post 13. The buffer 49 is located between two ribs 52 at the rear of the post 13. The post is then suspended from the rail 41 by locating the hooked part 46 in the channel 45 and its lateral position is adjusted until it is satisfactory. The buffer 49 abuts the wall 43. The post 13 can then be screwed back to the wall 43.

Figure 8:
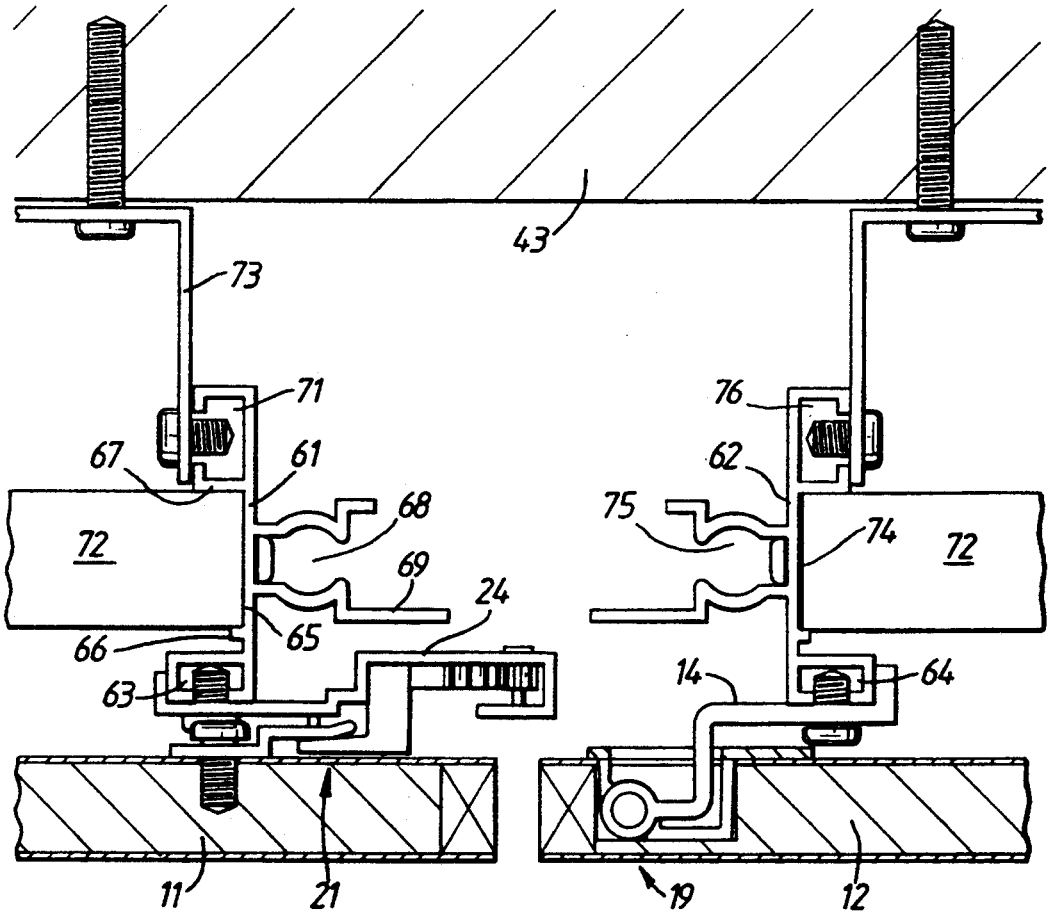
FIG. 8 is a view similar to FIG. 1 showing a system providing ducting.

FIG. 8 shows another embodiment of the invention in which the system provides ducting means behind the panels 11,12. The lock 21 and hinge 19 arrangements are similar to those shown in FIG. 1 and will therefore not be described in detail. However the dual function post 13 has been replaced by two identical (mirror image) single function posts 61,62.

The post 61 has a channel 63 which is identical in form and purpose to the channel 25 in the post 13. It therefore serves to locate the latch bracket 24. Similarly, the post 62 has a channel 64 which is identical in form and purpose to the channel 15 in the post 13. It therefore serves to locate the hinge bracket 14.

The post 61 also has a shallow slot 65 defined between a rib 66 and a shoulder 67, a large bore 68, a flange 69 and a second channel 71. The slot 65 locates cross members 72 (one of which is shown) which may be located at the top nd bottom of the post 61 and also at an intermediate position, where they are screwed in place. The large bore 68 receives a boss from a foot (not shown) and a similar boss from a head piece or inverted foot member (not shown). The second channel 71 allows a series of fixing brackets 73 to be screwed to the post 61. These brackets 73 are screwed back to the wall 43, thereby attaching the post 61 to the wall.

In a similar manner, the post 62 has a shallow slot 74 for the location of cross members 72, a large bore 75 for receiving foot and headpieces bosses (not shown) and a second channel 76 through which the post 62 is attached to the wall 43. The post also has a flange 77 which is equivalent to the flange 69. The purpose of the two flanges 69,77 will be described in connection with embodiment shown in FIG. 10.

Figure 9:
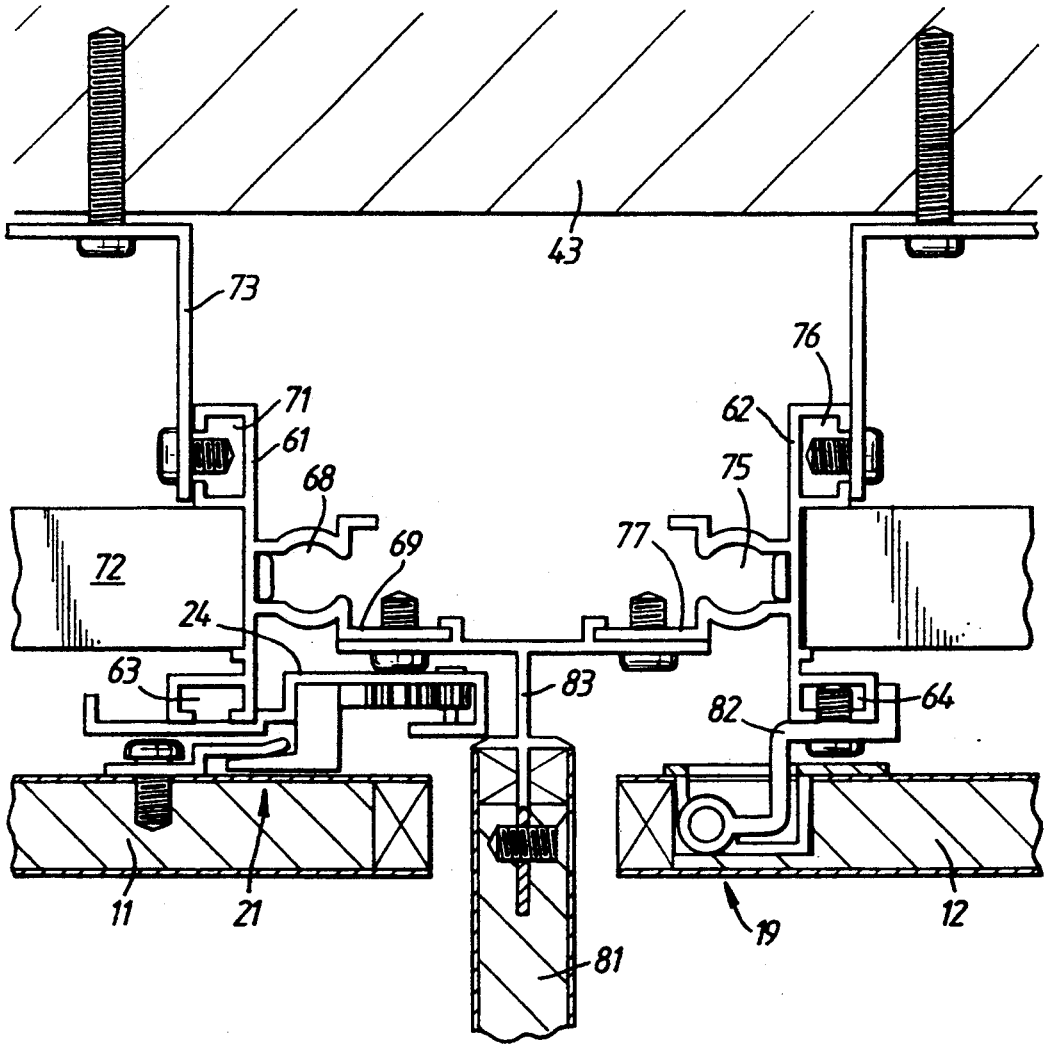
FIG. 9 is a view similar to FIG. 8 showing the system adapted to accommodate a partition.

FIG. 9 shows an embodiment which is very similar to that of FIG. 8 except that a partition 81 is accommodated at right-angles to the panels 11,12. In order to accommodate the partition 81, the gap between the adjacent panels 11,12, is increased. This embodiment consequently differs from the embodiment of FIG. 9 in three constructional respects.

Firstly, latch bracket 24 is attached to the post 61 at a different position, specifically, the latch bracket 24 is moved further to the left (as shown) relative to the post 61. The corresponding panel 11 is therefore also effectively moved relatively towards the left (as shown). Secondly, the other panel 12 is moved relatively to the right (as shown) by employing an alternative hinge bracket 82 which is laterally shorter than the standard hinge bracket 14, but is otherwise similar.

Thirdly, a partition bracket 83 is screwed or bolted to the two flanges 69, 77 and to this in turn, the partition is screwed or bolted.

I claim:

1. A wall panelling system comprising: two upright posts, a panel having a front face and a rear face, a hinge connecting said panel to one of said posts and means for locking said panel to the other of said posts; said posts having a cross-sectional shape providing features for the attachment of said hinge and said locking means; said locking means comprising a latch member pivotally mounted with respect to said first post, a catch fixed relative to said panel and an actuating element; said latch member being movable by means of said actuating element between a latched position in which said actuating element engages said catch and an unlatched position in which said actuating element does not engage said catch, said hinge comprising a hinge bracket and a first hinge element on said hinge bracket, said hinge bracket being fixed to said second post, and a second hinge element which is let into said rear surface of said panel, said first hinge element comprising a bush and said second hinge element comprising a housing including a pin on which said bush is pivotally mounted.

2. A wall panelling system comprising: two upright posts, a panel having a front face and a rear face, a hinge connecting said panel to one of said posts and means for locking said panel to the other of said posts; said posts having a cross-sectional shape providing features for the attachment of said hinge and said locking means; said locking means comprising a latch member pivotally mounted with respect to said first post, a catch fixed relative to said panel and an actuating element; said latch member being movable by means of said actuating element between a latched position in which said actuating element engages said catch and an unlatched position in which said actuating element does not engage said catch; said system further including a plurality of cross members including a top rail, a bottom rail, and an intermediate cross member, said cross members running between said posts, said posts also providing features for the attachment of said cross members.

3. A wall panelling system of claim 2 further comprising a latch bracket operably fixed to said second post, said latch member being pivotally mounted on said latch bracket.

4. A wall panelling system of claim 2, said latch member including a toothed portion and a pinion gear operably engageable with said toothed portion whereby rotation of said pinion gear moves said latch member between said latched and unlatched positions.

5. A wall panelling system of claim 2, wherein said hinge comprises a hinge bracket and a first hinge element operably carrier by said hinge bracket, said hinge bracket being operably carried by said first post, and a second hinge element which is let into said rear surface of said panel.

6. A wall panelling system of claim 5, wherein said first hinge element comprises a bush and said second hinge element comprises a housing including a pin on which said bush is pivotally mounted.

7. A wall panelling system of claim 2, wherein said posts are identical whereby each post provides the features necessary for engagement with two adjacent panels.

8. A wall panelling system of claim 2, further including a foot member for each said post, the cross sectional shape of each said post providing a feature for engagement with the respective post.

9. A wall panelling system comprising: two upright posts, a panel having a front face and a rear face, a hinge connecting said panel to one of said posts and means for locking said panel to the other of said posts; said posts having a cross-sectional shape providing features for the attachment of said hinge and said locking means; said locking means comprising a latch member pivotally mounted with respect to said first post, a catch fixed relative to said panel and an actuating element; said latch member being movable by means of said actuating element between a latched position in which said actuating element engage said catch and an unlatched position in which said actuating element does not engage said catch; said system further including a plurality of cross members running between said posts and brackets for attaching said posts to a wall, said posts also providing features for the attachment of said cross members and said brackets to said posts.

10. A wall panelling system of claim 9 further comprising a latch bracket operably fixed to said second post, said latch member being pivotally mounted on said latch bracket.

11. A wall panelling system of claim 9, said latch member including a toothed portion and a pinion gear operably engageable with said toothed portion whereby rotation of said pinion gear moves said latch member between said latched and unlatched positions.

12. A wall panelling system of claim 9, wherein said hinge comprises a hinge bracket and a first hinge element operably carrier by said hinge bracket, said hinge bracket being operably carried by said first post, and a second hinge element which is let into said rear surface of said panel.

13. A wall panelling system of claim 12, wherein said first hinge element comprises a bush and said second hinge element comprises a housing including a pin on which said bush is pivotally mounted.

14. A wall panelling system of claim 9, wherein said posts are identical whereby each post provides the features necessary for engagement with two adjacent panels.

15. A wall panelling system of claim 14, wherein each said post is adapted to be fixed directly to a wall.

16. A wall panelling system of claim 14, further including a horizontal rail adapted to be fixed to a wall and a suspension element adapted to be suspended from said rail and also adapted to be fixed to said posts.

17. A wall panelling system of claim 9, wherein said cross members comprises a top rail, a bottom rail and an intermediate cross member.

18. A wall panelling system of claim 9, further including a foot member for each said post, the cross sectional shape of each said post providing a feature for engagement with the respective post.

19. A wall panelling system of claim 9, wherein each said post is specifically dedicated to one side of one of said panels, whereby two adjacent panels will employ four said posts.

20. A wall panelling system of claim 19, further including means for the attachment of a partition, the cross-sectional shape of each said post providing a feature for engagement with said means for attachment of said partition.

* * * * *